US006311800B1

(12) United States Patent
St-Germain et al.

(10) Patent No.: US 6,311,800 B1
(45) Date of Patent: Nov. 6, 2001

(54) RAISING SYSTEM FOR SCAFFOLDING AND THE LIKE

(76) Inventors: André St-Germain, 1340, Rang du Bassin, St-Bonaventure QBC (CA), J0C 1C0; Luc Tessier, 1051, rue Clair, St-Nicéphore QBC (CA), J2A 2K2

( * ) Notice: Subject to any disclaimer, the term of this patent is extended or adjusted under 35 U.S.C. 154(b) by 0 days.

(21) Appl. No.: 09/662,602

(22) Filed: Sep. 14, 2000

Related U.S. Application Data

(63) Continuation of application No. 09/340,465, filed on Jun. 28, 1999, now abandoned.

(51) Int. Cl.[7] ..... E04G 1/18

(52) U.S. Cl. ..... 182/146; 182/82; 182/141; 74/465

(58) Field of Search ..... 182/63, 82, 141, 182/145, 146, 148; 74/424.6, 465; 248/235, 562; 474/152

(56) References Cited

U.S. PATENT DOCUMENTS

| | | | | |
|---|---|---|---|---|
| 1,159,486 | | 11/1915 | Froelich . | |
| 1,289,508 | | 12/1918 | Melcher . | |
| 3,071,205 | * | 1/1963 | Beck, Jr. | 182/146 |
| 4,282,777 | | 8/1981 | Ryffel et al. . | |
| 4,293,054 | * | 10/1981 | Pieri | 182/146 X |
| 4,294,332 | * | 10/1981 | Ready | 182/141 |
| 4,541,297 | | 9/1985 | Fujita . | |
| 4,664,226 | | 5/1987 | Centanne . | |
| 4,887,694 | | 12/1989 | Ho . | |
| 4,967,733 | | 11/1990 | Rousseau . | |
| 4,974,700 | | 12/1990 | Gates . | |
| 5,310,018 | | 5/1994 | Lahaie . | |
| 5,368,125 | | 11/1994 | St-Germain . | |
| 5,381,704 | | 1/1995 | Knotts . | |
| 5,392,878 | * | 2/1995 | Bennett et al. | 182/115 |
| 5,487,446 | | 1/1996 | Patnode et al. . | |
| 5,540,111 | | 7/1996 | Barnett et al. . | |
| 5,579,865 | * | 12/1996 | Butler et al. | 182/146 X |
| 5,636,705 | | 6/1997 | St-Germain . | |
| 5,644,950 | | 7/1997 | Parsons . | |
| 5,704,248 | | 1/1998 | Knotts . | |
| 5,746,290 | * | 5/1998 | St-Germain et al. | 182/146 |
| 6,095,285 | * | 8/2000 | St-Germain | 182/146 |

* cited by examiner

*Primary Examiner*—Bruce A. Lev

(57) ABSTRACT

A raising system for scaffolding, elevator cabins and the like which comprises a vertical stationary beam member from one side of which equally vertically spaced similar rack teeth are protruding, each tooth having a substantially horizontal straight top face, a framework guided for up and down movement along said beam member, a power driven shaft rotatably supported by said framework and carrying spaced radial supports, a series of parallel idle shafts extending between the supports, equally spaced from one another and radially equally spaced from the driven shaft, and a plurality of cylindrical roller assemblies rotatably mounted on the idle shafts and adapted to come in successive rolling engagement with the top faces of said teeth during upward or downward movement of said framework. Each roller assembly includes several rollers disposed side by side.

16 Claims, 5 Drawing Sheets

RAISING SYSTEM FOR SCAFFOLDING AND THE LIKE

CROSS REFERENCE TO RELATED APPLICATION

This application is a Continuation of U.S. patent application Ser. No. 09/340,465 of St-Germain et al filed on Jun. 28, 1999 now abandon.

FIELD OF THE INVENTION

The present invention relates to a raising system for a scaffolding platform, an elevator cage and the like.

BACKGROUND OF THE INVENTION

It has been known for a long time to use a rack and pinion system for raising scaffolding work platforms or elevator cages. Due to the frictional contact of the pinion teeth with the rack teeth, it is necessary to grease the teeth from time to time. Such a greasing operation is time-consuming and difficult to perform on the rack of an outside scaffolding assembly. Such rack is normally secured to a tower which may rise several stories. Falling particles may often adhere to the greased teeth and cause malfunctioning of the raising system because of poor meshing engagement of the pinion with the rack.

OBJECTS OF THE INVENTION

It is therefore the main objective of the present invention to provide a rack and pinion system which have use for elevators and scaffoldings and which obviates the above noted disadvantages.

Another object of the present invention is to provide a rack and pinion system into which the pinion has a friction free engagement with the rack teeth so as to eliminate any necessity of applying grease to the rack teeth and to the pinion.

Another object to the present invention is to provide a rack and pinion raising system which is capable of raising important loads of one thousand pounds or more.

SUMMARY OF THE INVENTION

The present invention is directed to a raising system for scaffolding platforms, elevator cages and the like comprising an upright stationary beam member, a series of equally spaced similar rack teeth secured to said beam member and laterally projecting from the same, each rack tooth having a substantially horizontal, straight top face, a tip and an under face, and a framework guided for vertical up and down movement along said beam member, a pinion device mounted on said framework and meshing with said rack teeth, said pinion including a power driven shaft rotatably supported by said framework, spaced from, normal to and extending across said beam member, a pair of spaced parallel radial supports secured to said power driven shaft and a series of parallel idle shafts extending between said supports, equally spaced from one another and equally radially spaced from said power driven shaft, and a cylindrical roller assembly rotatably mounted on each idle shaft, said cylindrical roller assemblies equal diameter and of a length slightly less than the distance between said two supports, said roller assemblies freely rotatable on their respective idle shafts, clearing said under faces and bearing on and rolling over the top faces of said rack teeth upon said power driven shaft rotating in one direction to raise said framework along said upright beam member or in the other direction to lower said framework along said beam member.

The diameter of said roller assemblies is smaller than the vertical distance between the top face of an underlying tooth and the under face of an overlying adjacent tooth so that a gap is left between the under face of said overlying tooth and a roller assembly in rolling contact with the top face of said underlying tooth.

Preferably, said under face is downwardly sloping in a direction away from said tip.

Preferably needle bearings are interposed between said idle shafts and said roller assemblies.

Preferably said under face is downwardly sloping in a direction away from said tip.

Preferably, each roller assembly includes several rollers disposed side by side.

Preferably a sleeve is tightly fitted around said several rollers.

Preferably, the spacing between adjacent roller assemblies and their radial spacing from said power driven shaft are such that adjacent roller assemblies successively roll over the top faces of adjacent teeth.

Preferably, said power driven shaft has two opposite ends, each protruding from said framework and further including a pair of hydraulic motors respectively drivingly connected to said opposite ends.

The present invention is also directed to the combination of the above defined raising system with a scaffolding including a multi-sided tower, a sleeve member mounted around said tower for guided up and down movement and a work platform supported by said sleeve member, said stationary beam member secured to one side of a said tower, said framework secured to and outwardly protruding from said sleeve member at said one side of said tower, and further including a safety lever pivoted to said framework and counterweighted to ride over said teeth tips and automatically pivot over each adjacent rack tooth during said upward movement of said sleeve member.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
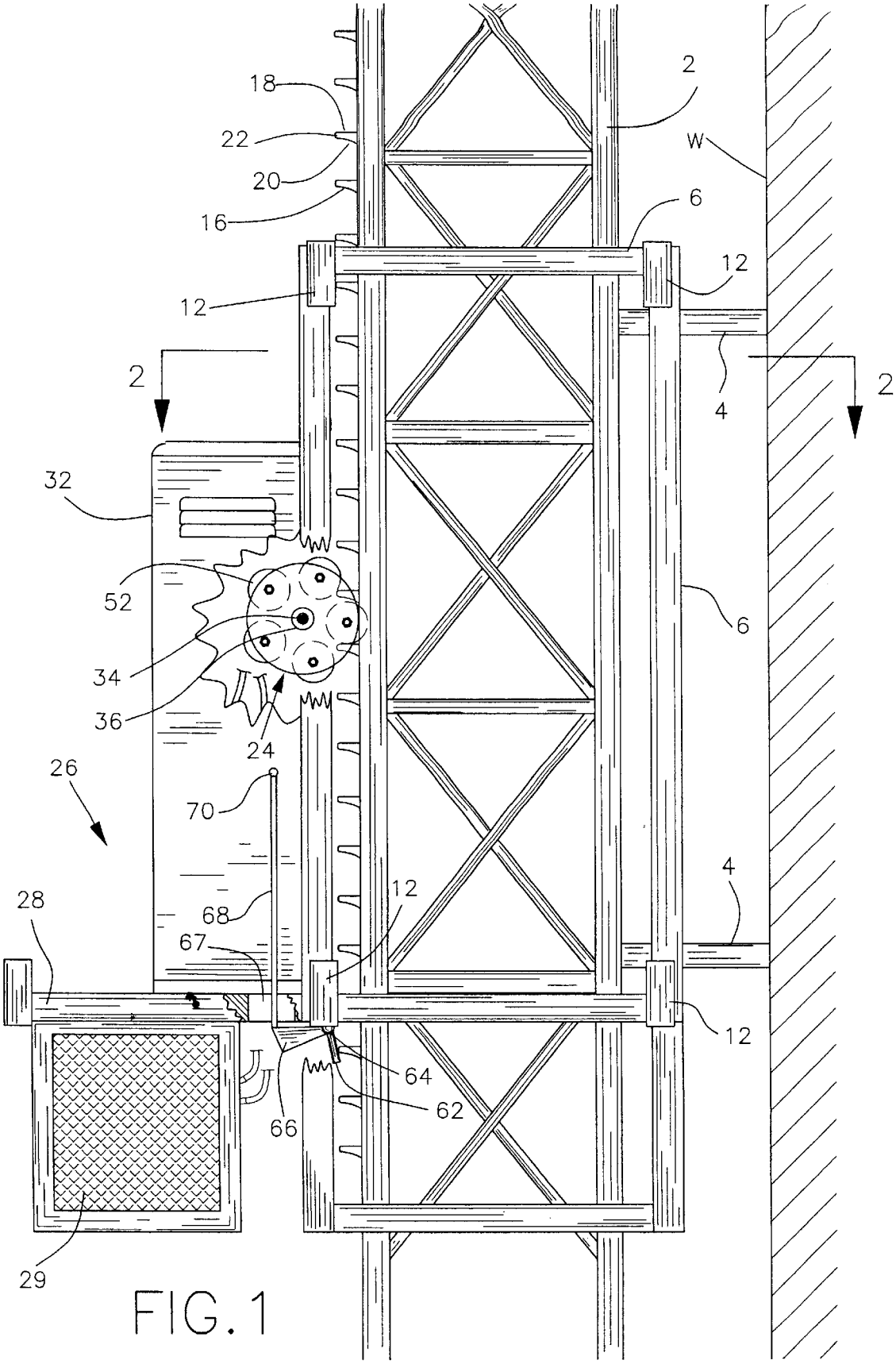
FIG. 1 is a partial elevation, partially in section, of a scaffolding system including a tower with a rack, a sleeve member guided up and down along the tower and a pinion meshing with the rack teeth.
Figure 2:
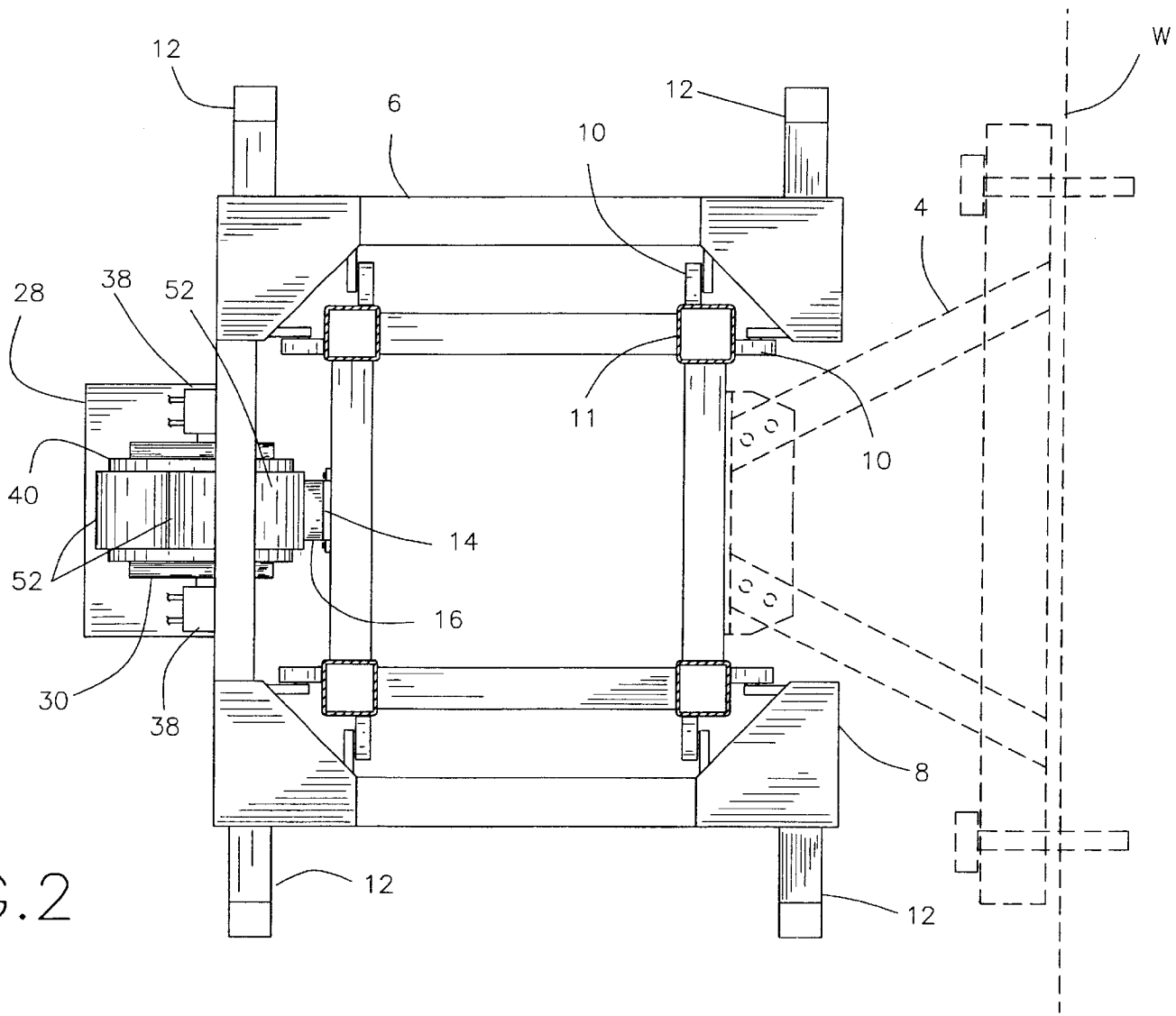
FIG. 2 is a plan section taken along line 2—2 of FIG. 1.

Referring to FIGS. 1 and 2, there is shown a tower 2 spaced from and secured to wall W by vertically spaced wall anchors 4. A sleeve member 6 partially surrounds tower 2 leaving an opening 8 facing wall W so that sleeve member 6 may clear the wall anchors 4 during its up and down movement along tower 2. Sleeve member 6 is guided along tower 2 by guiding rollers 10 rolling over the corner posts 11 of tower 2. Both tower 2 and the sleeve member 6 preferably have a square cross-section. Hooks 12 are secured to the sleeve member 6 at its side normal to the wall W in order to suspend a work platform (not shown) used by the workmen such as bricklayers.

The raising system of the invention includes a vertical beam 14 secured to tower 2 on its side opposite to the wall anchors 4. Rack teeth 16 are welded or otherwise rigidly secured to or integral with vertical beam 14 at equal distances. Each rack tooth 16 has a top horizontal straight face 18, a curved under face 20 sloping downwardly away from the tip 22 of the tooth 16.

A pinion device generally indicated at 24 is adapted to mesh with the rack teeth 16. Pinion device 24 is mounted on a framework 26 which is rigidly secured to the sleeve member 6. This framework 26 extends on the side of the sleeve member 6 away from wall anchors 4 and includes a shelf 28 and braces 30 secured to sleeve member 6. A housing 32 is supported on shelf 28 to partially enclose the pinion device 24 and the driving motors therefor. The driving motors are energized by a proper source of energy, such as an internal combustion engine driving a hydraulic pump, contained in a separate structure 29 preferably secured underneath the shelf 28.

The pinion device 24 comprises a power driven shaft 34 which rotates in journals 36 secured to the braces 30. Power driven shaft 34 has its opposite ends protruding from the respective journals 36 to be directly connected each to a hydraulic motor 38.

Pinion 24 includes a pair of equal diameter discs 40 surrounding and secured to power driven shaft 34. Each of the discs 40 supports a plurality of idle shafts 46 radially equally spaced from driven shaft 34 and equally spaced from each other. Each idle shaft 46 has threaded ends and adjacent shoulders 48 against which the two discs 40 abut to keep at a set distance apart. Nuts 50 secure discs 40 to idle shaft 46. A roller assembly 52 is rotatably mounted on each idle shaft 46 with the interposition of washers 54. Each roller assembly 52 preferably consists of three rollers 56 disposed side by side and each mounted on a needle bearing 58. A sleeve 60 tightly surrounds the assembly of the three rollers 56. Preferably, five roller assemblies are carried by discs 40 and partially protrude from the same as shown in FIG. 4.

Figure 4:
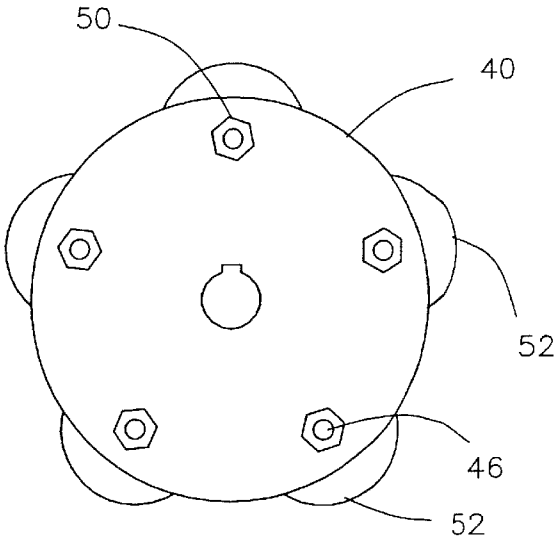
FIG. 4 is a side elevation of the same.
Figure 5:
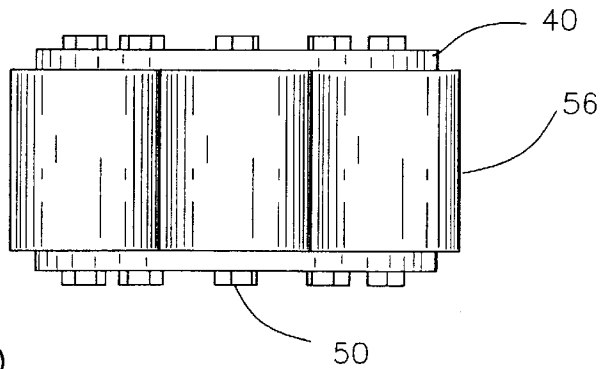
FIG. 5 is a top plan view of the same.
Figure 3:
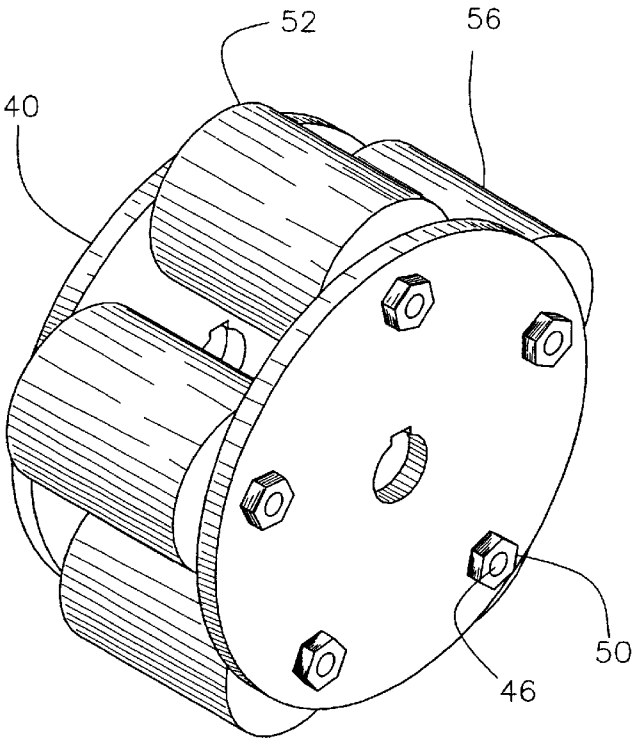
FIG. 3 is a perspective view of the pinion.
Figure 6:
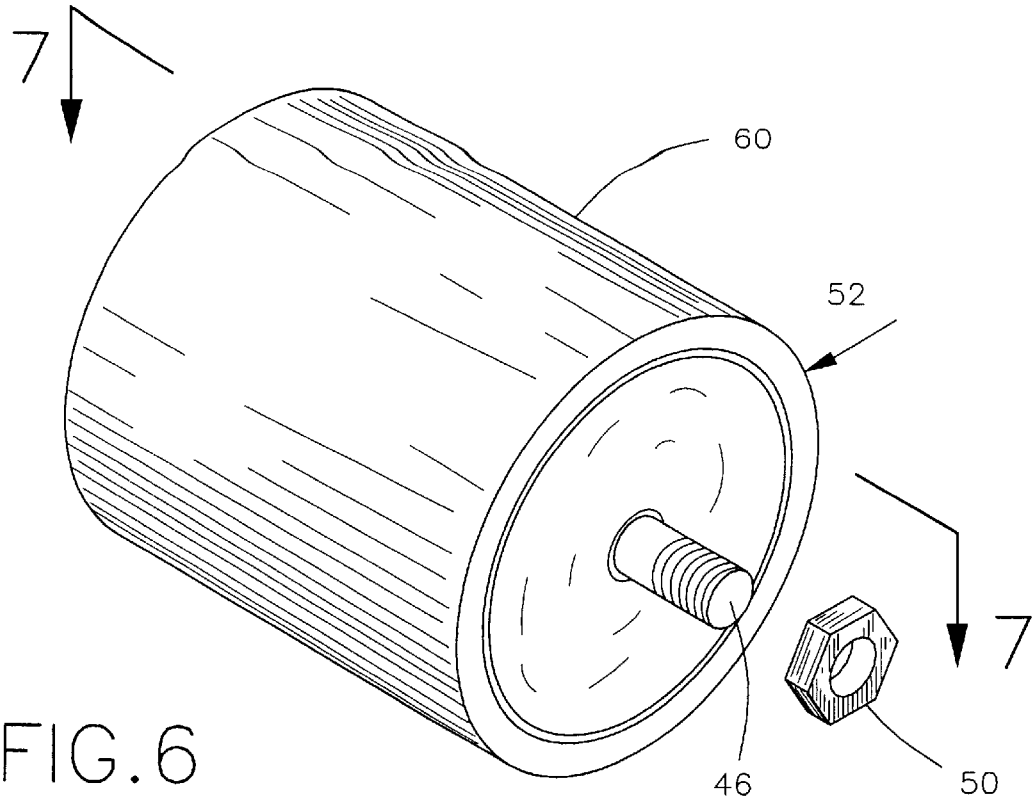
FIG. 6 is a partially exploded perspective view of one roller assembly.
Figure 7:
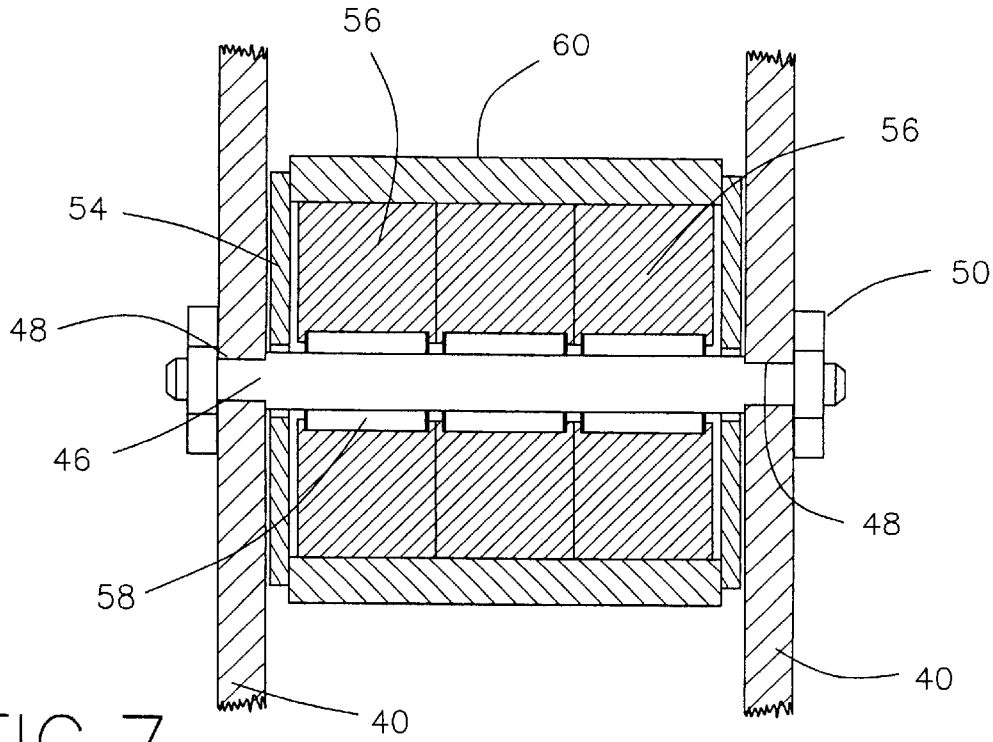
FIG. 7 is a longitudinal section of the assembly of FIG. 6.

In FIGS. 3 to 5, sleeve 60 illustrated in FIGS. 6 and 7 is absent since it is not essential and could be dispensed with.

The diameter of each roller assembly 52 is smaller than the vertical distance between the top face 18 of an underlying tooth 16 and the under face 20 of an underlying tooth 16 so that a gap is left between the under face 20 of a tooth 16 and the roller assembly 52 in contact with the top face 18 of an adjacent underlying tooth 16.

It is to be noted that since the rack and tooth pinion is always subjected to gravity, each roller assembly 52 only contacts the top face 18 of the successive rack tooth 16 and never has to contact the under face 20 of said tooth whether the sleeve member 6 is raising or going down along the tower 2.

Figure 10:
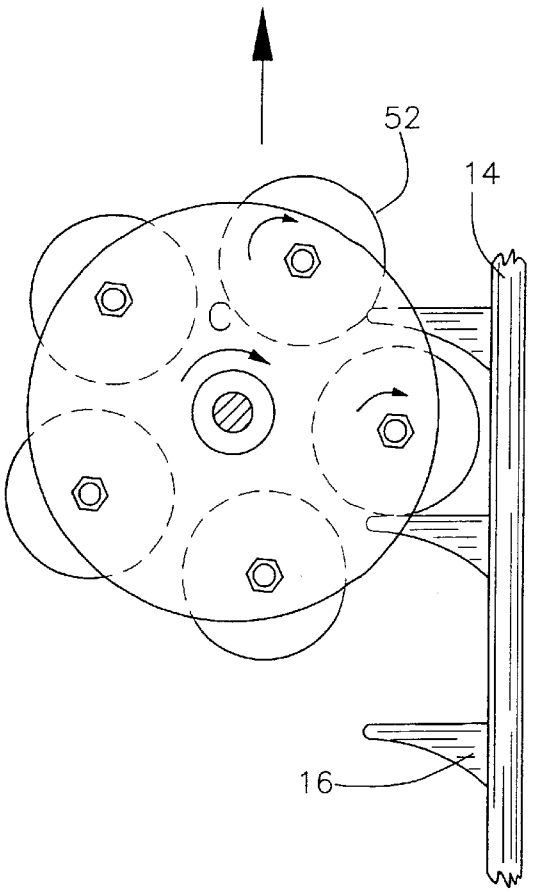
FIGS. 8, 9 and 10 are partial side views showing how the roller assemblies of the pinion roll on the rack teeth.
Figure 9:
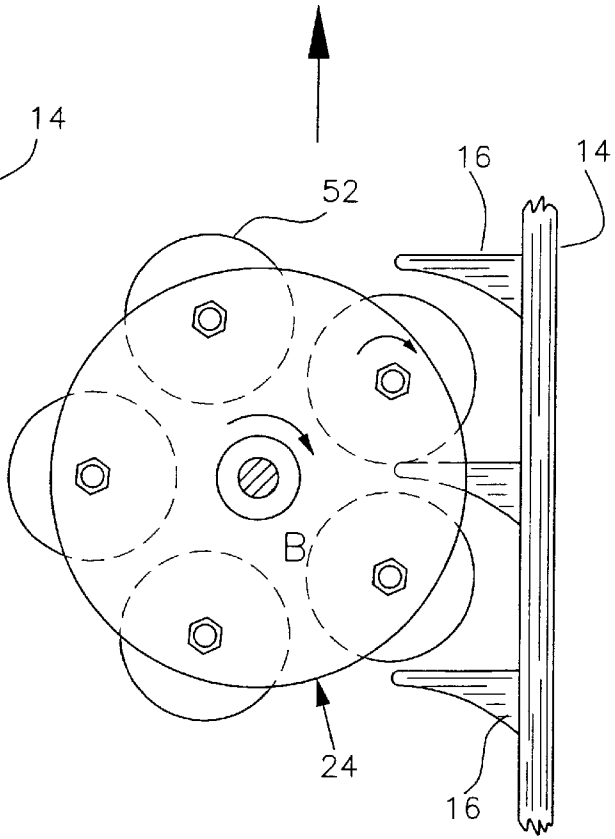
Figure 8:
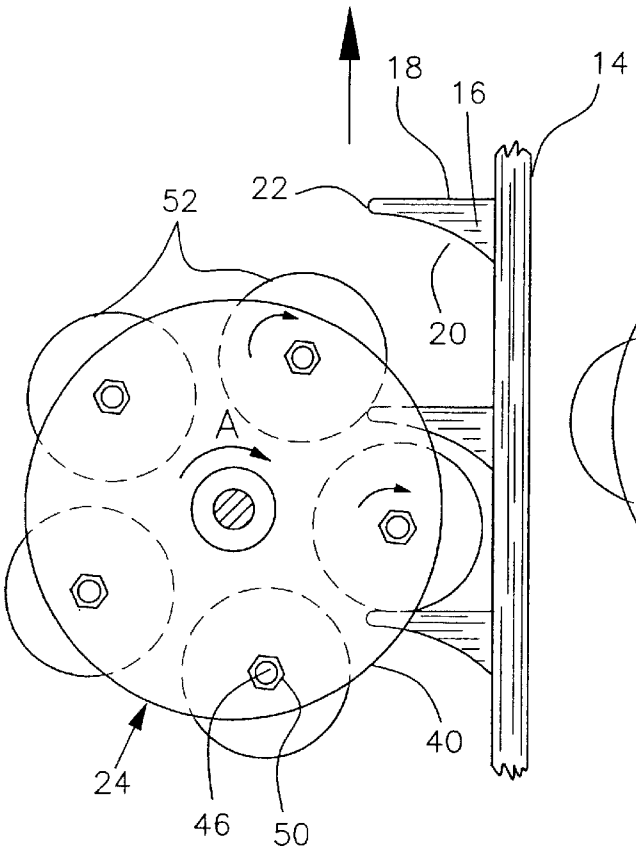

As shown in FIGS. 8, 9 and 10, during rotation of the pinion device 24 in accordance with arrows A, B and C respectively, the roller assemblies 52 will successively engage the next upper rack tooth 16 and will simply roll on the top face 18 of the rack tooth 16 without any friction. Also there is never any friction between roller assembly 52 and the under face 20 of the underlying tooth 16 whether the sleeve member 6 goes up or down the tower 2. It is not necessary to apply grease either to rack teeth 16 or to roller assemblies 52. The system works very well even in an environment which is dusty or in which falling particles may deposit on the rack teeth.

The fact that two hydraulic motors 38 are connected to opposite ends power driven shaft 34 enables to decrease the torsional force exerted on this shaft 34 especially during raising movement of the sleeve member 6 under load.

When the system is used for scaffolding, it is preferable to provide safety lever 62 which is horizontally pivoted under shelf 28 by a pivot 64 and which is engageable with the top face 18 of successive teeth 16 under the action of counterweight 66 secured to the lever 62 and extending in a direction opposite to the teeth 16. As sleeve member 6 is elevated, safety lever 62 will slide over the rack tooth tips 22 and automatically take a position overlying the tooth 16. When sleeve member 6 and its platform is being lowered, means are provided to retain the lever 62 in a position to clear the successive teeth 16. Preferably, an arm 68 is rigidly secured to counterweight 66 at one end, and is adapted to receive a handle 70 at the other end. The arm 68 extends through an opening 67 in the shelf 28, and the handle 70 is lifted up by a workman and held in that position to make the lever 62 to clear the teeth 16.

Obviously the raising system of the invention can be used in conjunction with an elevator cage, with the rack 14 and its teeth 16 disposed on opposite sides of the cage. In this case two oppositely mounted pinion devices 24 could be used.

Although an embodiment of the present invention has been illustrated in the accompanying drawings and described in the foregoing detailed description, it will be understood that the invention is not limited to the embodiment disclosed, but is capable of numerous rearrangements, modifications, and substitutions without departing from the scope of the invention as hereinafter claimed.

We claim:

1. A raising system for raising platforms comprising an upright stationary beam member, a series of equally spaced similar rack teeth secured to said beam member and laterally projecting from the same, each rack tooth having a substantially horizontal, straight top face, a tip and an under face, and a framework guided for vertical up and down movement along said beam member, a pinion device mounted on said framework and meshing with said rack teeth, said pinion including a power driven shaft rotatably supported by said framework, spaced from, normal to and extending across said beam member, a pair of spaced parallel radial supports secured to said power driven shaft and a series of parallel idle shafts extending between said supports, equally spaced from one another and equally radially spaced from said power driven shaft, and a cylindrical roller assembly rotatably mounted on each idle shaft, said cylindrical roller assemblies of equal diameter and of a length slightly less than the distance between said two supports, said roller assemblies freely rotatable on their respective idle shafts, clearing said under faces and bearing on and rolling over the top faces of said rack teeth upon said power driven shaft rotating in one direction to raise said framework along said upright beam member or in the other direction to lower said framework along said beam member, each of said roller assemblies includes several rollers disposed side by side.

2. A raising system as defined in claim 1, wherein the diameter of said roller assemblies is smaller than the vertical distance between the top face of an underlying tooth and the under face of an overlying adjacent tooth so that a gap is left between the under face of said overlying tooth and a roller assembly in rolling contact with the top face of said underlying tooth.

3. A raising system as defined in claim 2, wherein said under face is downwardly sloping in a direction away from said tip.

4. A raising system as defined in claim 3, further including needle bearings interposed between said idle shafts and said roller assemblies.

5. A raising system as defined in claim 4, further including a sleeve tightly fitted around said several rollers.

6. A raising system as defined in claim 1, wherein said under face is downwardly sloping in a direction away from said tip.

7. A raising system as defined in claim 1, further including needle bearings interposed between said idle shafts and said roller assemblies.

8. A raising system as defined in claim 1, wherein the spacing between adjacent roller assemblies and their radial spacing from said power driven shaft are such that adjacent roller assemblies successively roll over the top faces of adjacent teeth.

9. A raising system as defined in claim 1, wherein said power driven shaft has two opposite ends, each protruding from said framework and further including a pair of hydraulic motors respectively drivingly connected to said opposite ends.

10. A combination of a raising system and a scaffolding including a multi-sided tower, a sleeve member mounted around said tower for guided up and down movement and a work platform supported by said sleeve member, said raising system comprising a series of equally spaced similar rack teeth secured to one side of said tower and laterally projecting from the same, each rack tooth having a substantially horizontal, straight top face, a tip and an under face, a framework secured to and outwardly protruding from said sleeve member at said one side of said tower, a pinion device mounted on said framework and meshing with said rack teeth, said pinion including a power driven shaft rotatably supported by said framework, spaced from, normal to and extending across said tower, a pair of spaced parallel radial supports secured to said power driven shaft and a series of parallel idle shafts extending between said supports, equally spaced from one another and equally radially spaced from said power driven shaft, and a cylindrical roller assembly rotatably mounted on each idle shaft, said cylindrical roller assemblies of equal diameter and of a length slightly less than_the distance between said two supports, said roller assemblies freely rotatable on their respective idle shafts, clearing said under faces and bearing on and rolling_over the top faces of said rack teeth upon said power driven shaft rotating in one direction to raise said framework and sleeve member along said tower or in the other direction to lower said framework and sleeve member along said tower, and further including a safety lever pivoted to said framework and counterweighted to ride over said teeth tips and automatically pivot over each adjacent rack tooth during said upward movement of said sleeve member, each of said roller assemblies includes several rollers disposed side by side.

11. In a combination as defined in claim 10, wherein the diameter of said roller assemblies is smaller than the vertical distance between the top face of an underlying tooth and the under face of an overlying adjacent tooth so that a gap is left between the under face of said overlying tooth and a roller assembly in rolling contact with the top face of said underlying tooth.

12. In a combination as defined in claim 11, wherein said under face is downwardly sloping in a direction away from said tip.

13. In a combination as defined in claim 12, further including needle bearings interposed between said idle shafts and said roller assemblies.

14. In a combination as defined in claim 13, further including a sleeve tightly fitted around said several rollers.

15. In a combination as defined in claim 14, wherein the spacing between adjacent roller assemblies and their radial spacing from said power driven draft are such that adjacent roller assemblies successively roll over the top faces of adjacent teeth.

16. In a combination as defined in claim 15, wherein said power driven shaft has two opposite ends, each protruding from said framework and further including a pair of hydraulic motors respectively drivingly connected to said opposite ends.

* * * * *